US009976838B1

(12) United States Patent
Langner

(10) Patent No.: US 9,976,838 B1
(45) Date of Patent: May 22, 2018

(54) METHODS AND APPARATUS FOR DISARMING AN EXPLOSIVE DEVICE

(71) Applicant: F. Richard Langner, Fountain Hills, AZ (US)

(72) Inventor: F. Richard Langner, Fountain Hills, AZ (US)

( * ) Notice: Subject to any disclaimer, the term of this patent is extended or adjusted under 35 U.S.C. 154(b) by 0 days. days.

(21) Appl. No.: 15/623,269

(22) Filed: Jun. 14, 2017

Related U.S. Application Data

(60) Provisional application No. 62/350,714, filed on Jun. 16, 2016.

(51) Int. Cl.
*F42B 33/06* (2006.01)

(52) U.S. Cl.
CPC ..... *F42B 33/062* (2013.01)

(58) Field of Classification Search
CPC ..... F42B 33/062; F42B 33/06
USPC ..... 86/50
See application file for complete search history.

(56) References Cited

U.S. PATENT DOCUMENTS 3,520,477 A * 7/1970 Cooley ..... B05B 12/06 239/101
9,534,864 B2 * 1/2017 Dey ..... F41B 9/0046

FOREIGN PATENT DOCUMENTS

EP 198728 * 10/1986

* cited by examiner

*Primary Examiner* — Stephen Johnson
(74) *Attorney, Agent, or Firm* — Letham Law Firm LLC; Lawrence Letham

(57) ABSTRACT

A disrupter cannon and a reducer for increasing a pressure of water expelled from the disrupter cannon to disable an explosive device housed in a hardened container.

18 Claims, 2 Drawing Sheets

METHODS AND APPARATUS FOR DISARMING AN EXPLOSIVE DEVICE

This application claims domestic priority from U.S. provisional application 62/350,714, as filed on Jun. 16, 2016.

FIELD OF THE INVENTION

Embodiments of the present invention relate to disrupter cannons used to disable explosive devices.

BACKGROUND OF THE INVENTION

Disrupter cannons are used by military, bomb squad, and other emergency service personnel to destroy and/or disable explosive devices including improvised explosive devices ("IED"), bombs, and ordinance.

Disrupter cannons propel a projectile to impact the explosive device. Impact of the projectile with the explosive device may interfere with (e.g., damage, destroy) a portion of the explosive device to disable the explosive device. Impact of the projectile with the explosive device may trigger (e.g., start, initiate, cause) explosion of the explosive device thereby destroying the device.

Some conventional disrupter cannons launch a bullet-like projectile. Other conventional disrupter cannons launch a projectile in the form of column of water from the barrel of the disrupter cannon.

Disrupter cannons may benefit from improving the effectiveness of using water as a projectile to disable an explosive device.

BRIEF DESCRIPTION OF THE DRAWING

Embodiments of the present invention will now be further described with reference to the drawing, wherein like designations denote like elements, and.

DETAILED DESCRIPTION OF THE PREFERRED EMBODIMENTS

Figure 1:
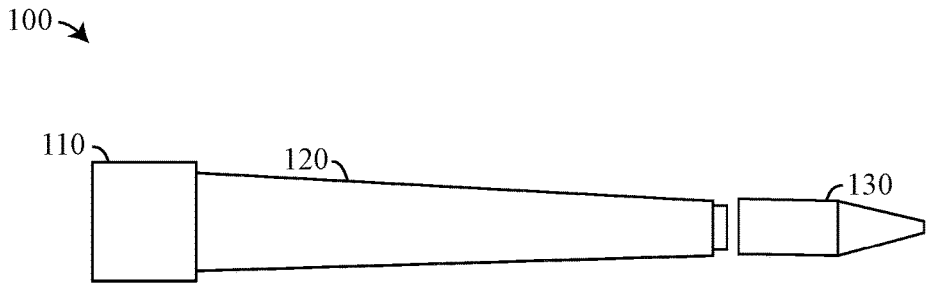
FIG. 1 is a view of a disrupter cannon and a nozzle according to various aspects of the present disclosure.

U.S. provisional patent application 62/350,714 filed on Jun. 16, 2016 is incorporated herein by reference for all purposes.

A disrupter cannon includes a barrel (e.g., 120) and a breech cap (e.g., 110). The barrel incudes a beech-end portion (e.g., 222) and a muzzle-end portion (e.g., 224). A breech cap couples to the breech-end portion of a barrel. A cartridge and a projectile may be inserted into the breach and the breech cap coupled to the breech. The projectile may be coupled to the cartridge prior to insertion into the breech. Firing (e.g., igniting, operating, initiating) the cartridge launches the projectile out the barrel toward an explosive device. The projectile may strike the explosive device thereby disabling the explosive device.

The barrel of a disrupter cannon may also be filled with water. The water may be launched from the barrel toward an explosive device. To launch water from the barrel of a disrupter cannon, a water-proof or water-resistant cartridge may be inserted into the breech and the breech cap coupled to the breech. A portion of the water resistant cartridge (e.g., seal 252) may contact an inner surface of the barrel to reduce or completely stop water from leaking (e.g., exiting) from the barrel via the breech.

A barrel may be filled with water and a plug inserted into the muzzle-end portion of the barrel to hold (e.g., retain) the water in the barrel. The water is retained in the barrel until the cartridge is ignited. Rapidly expanding gas from the ignited cartridge applies a force to the water, which applies a force on the plug. The rapidly expanding gas forcefully expels the plug and the water from the barrel toward the explosive device to disable the explosive device.

Water launched from a disrupter cannon, as described above, is effective in disabling explosive devices that are house in containers that are relative soft (e.g., soft targets), such as paper, cardboard, plastic, tin foil, and fabric (e.g., vest). Water launched from a disrupter, as described above, toward explosive devices house in containers that are relatively hard (e.g., hard targets), such as steel (e.g., steel pipe, steel tubing, brief case, expended large-caliber cartridge) are less effective at penetrating and/or disabling the explosive device.

However, it is possible to increase the effectiveness of water against hard targets by increasing the pressure and/or speed of delivery of the water against hard targets. Further, decreasing the diameter of the stream of water improves the effectiveness of using water as a projectile against hard targets because the force of the water is delivered over a reduced area thereby increasing the ability of the water to penetrate the container of the explosive device to disable the explosive device.

According to various aspects of the present disclosure, a nozzle coupled to the muzzle-end portion of the barrel can increase the pressure and/or speed of delivery of the water from the barrel against a hard target. Further, because the water in the barrel is forced through an orifice of the nozzle that is much smaller in diameter (e.g.,. cross-sectional area) than the diameter of the muzzle-end opening of the barrel, the diameter of the column of water is much smaller and more effective at piercing (e.g., penetrating, cutting) the containers of hard targets to disrupt the explosive components inside the container.

Figure 2:
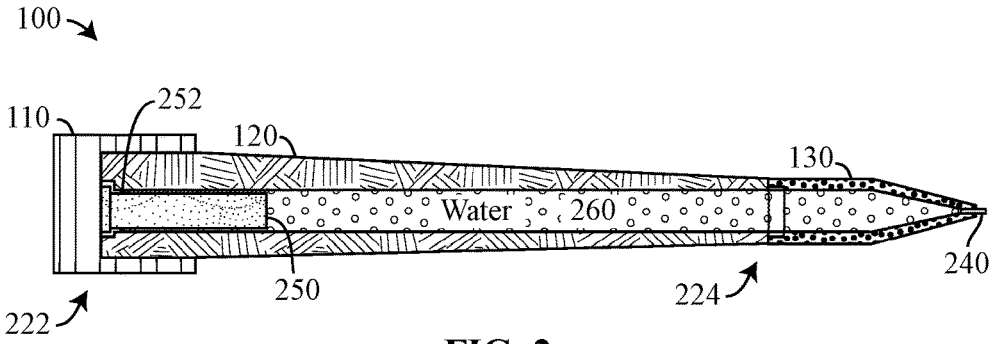
FIG. 2 is a cross-section of the disrupter cannon with the reducer attached, the cross section along a central axis of the disrupter cannon.
Figure 3:
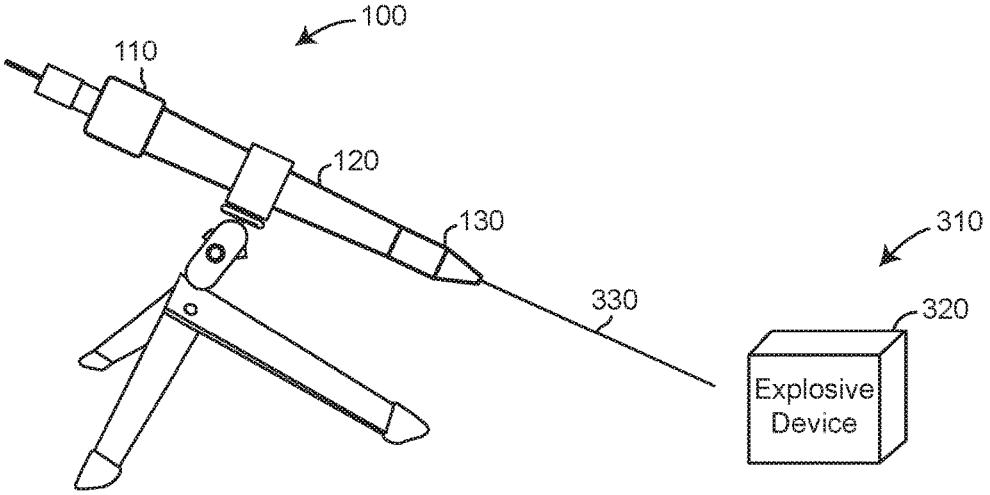
FIG 3 is a view of disrupter launching water toward an explosive device.

For example, referring to FIGS. 1 and 2, disrupter cannon 100 includes barrel 120, breech cap 110. Breech cap 110 couples to barrel 120 using any conventional coupling. In an embodiment, breech cap 110 threadedly couples to barrel 120. Barrel 120 includes breech-end portion 222 and muzzle-end portion 224. Breach cap 110 couples to breech-end portion 222 of barrel 120. Water-proof or water-resistant cartridge 250 may be inserted in to breech-end portion 222. Seal 252 around cartridge 250 may contact an inner surface of the bore of barrel 120 to seal between cartridge 250 and barrel 120 to inhibit (e.g., slow) or stop the exit of water 260 from barrel 120 via breech-end portion 222. The interior of barrel 120 may be filled with water 260.

Nozzle 130 may be coupled to the muzzle-end portion 224 of barrel 120 of disrupter cannon 100 in any conventional manner (e.g., threads, bayonet mount, press fit). The coupling of the nozzle to the muzzle-end portion of the barrel must be able to withstand the increased pressure inside the barrel and nozzle that results from reducing the diameter of the exit (e.g., opening) of the barrel that results from attaching the nozzle.

For example, nozzle 130 couples to barrel 120 at muzzle-end portion 224. In an implementation, nozzle 130 threadedly couples to muzzle-end potion 224 of barrel 120. Nozzle 130 includes an orifice (not labeled). Plug 240 may be inserted in to the orifice to retain water 260 in barrel 120. Plug 240 may retain water 260 in barrel 130 until ignition of cartridge 250.

Attaching nozzle 130 to barrel 120 reduces the diameter of the exit from barrel 120 from the diameter of the bore of barrel 120 to the diameter of the orifice of nozzle 130. A nozzle may reduce the diameter of the exit of the barrel by any amount (e.g., one-half, one-fifth, one-tenth, one-twentieth). For example, in one implementation, breech-end portion 222 of barrel 120 accepts a cartridge that has about the same diameter as a conventional 12-gauge shotgun shell. The diameter of a conventional 12-gauge shotgun shell is between 18.3 millimeters (e.g., mm) and 20.3 mm. Assuming that the diameter of the bore at muzzle-end portion 224 is about the same as the diameter of the cartridge, the diameter of the muzzle-end of the barrel is between 18.3 mm and 20.3 mm.

The diameter of the orifice of nozzle 130 may be any fraction of the diameter of the bore of muzzle-end portion 224 of barrel 120; however, barrel 120, nozzle 130, and the coupler that couples nozzle 130 to barrel 120 must be of sufficient strength to withstand the strain of the increased pressure inside the barrel that results from forcing water 260 to exit via the smaller diameter orifice of nozzle 130 rather than the larger diameter of the bore of barrel 120. The increase in pressure inside barrel 120 and nozzle 130 is proportional to the reduction of the diameter of the exit from barrel 120 through which water 260 must pass. The increase in pressure may be proportional to the ratio of the diameter of the bore of barrel 120 to the diameter of the orifice of nozzle 130.

In an implementation, the diameter of the orifice of nozzle 130 is between 5% (e.g., 1/20) to 20% (1/5) of the diameter of the bore of barrel 120. In an implementation, the diameter of the orifice of the nozzle is 10% (e.g., 1/10) of the diameter of the bore of the barrel at the muzzle-end portion. In another implementation, the diameter of the orifice of the nozzle is 20% (e.g., 1/5) of the diameter of the bore of the barrel at the muzzle-end portion.

Reducing the diameter of the muzzle-end portion of the barrel may be accomplished by any structure capable of coupling to the barrel and directing the flow of water from the barrel out an orifice of reduced diameter (e.g., less than diameter of bore of barrel). Such a structure may be referred as a reducer. A reducer may include a nozzle such as nozzle 130, a cap with an outlet that couples to the muzzle-end portion of the barrel, and an insert with a passage that inserts into the muzzle-end portion of the barrel. Further, the barrel may be formed so that the diameter at the breech-end portion is greater than the diameter of the muzzle-end portion so that the reduction of diameter at the exit of the barrel is integral with the barrel; however, such a barrel may be incapable of launching a projectile other than water or some other liquid.

Preparing disrupter cannon 100 and nozzle 130 for use includes placing water-proof or water resistant cartridge 250 in the breech-end of barrel 120. Coupling breech cap 110 to breech-end portion 222. Filling the bore of barrel 120 with water 260 via muzzle-end portion 224. Coupling nozzle 130 to breech-end portion 224 of barrel 120. Placing plug 240 in the orifice of nozzle 130 to retain water 260 in barrel 120.

When cartridge 120 is ignited, the rapidly expanding gas from cartridge 120 presses against water 260 in the bore of barrel 120. As the pressure inside barrel 120 increases, plug 240 in the orifice of nozzle 130 is pushed out so that water 260 may exit. However, since the exit (e.g., the orifice of nozzle 130) from disrupter cannon 100 is so much smaller than the diameter of the bore of barrel 120 without nozzle 130, the pressure inside barrel 120 increases thereby applying even more force on water 260. Water 260 exits nozzle 130 at a pressure that is higher than it would exit from barrel 120 without nozzle 130. The increase in pressure of water 260 increases the force applied by water 260 to container 320 of explosive device 310. Stream 330 of water 260 from nozzle 130 is smaller in diameter than the column of water from barrel 120 without nozzle 130, so stream 330 contacts a smaller area of container 320 with a higher force thereby providing the force needed to cut through the container of a hard target explosive device to disrupt the explosive device. The water also wets the explosive device there by reducing the likelihood that explosive device will ignite.

After firing water 260 from barrel 120 with nozzle 130, nozzle 130 may be detached to prepare for another water shot or to fire a projectile that such as a slug or bullet.

In another implementation, barrel 120 is filled with water from breech-end portion 222. Nozzle 130 is attached to barrel 120. Plug 240 is placed in the orifice of nozzle 130. The bore of barrel 120 is filled with water 260 via breech-end portion 222. Cartridge 250 is inserted into breech-end portion 222. Seal 252 around cartridge 250 contacts an inner surface of the bore of barrel 120 to seal water 260 in barrel 120. Breech cap 110 is coupled to beech-end portion 222 of barrel 120. Disrupter cannon 100 is ready to be fired as discussed above.

In another implementation, instead of using a water-resistant or a water-proof cartridge, a plug is placed in the barrel forward, with respect to the direction of launching, of the cartridge then a non-water proof cartridge is inserted into the breech-end portion. The plug prevents or reducing escape of the water from the barrel into the breach or around the cartridge positioned in the breech.

The foregoing description discusses preferred embodiments of the present invention, which may be changed or modified without departing from the scope of the present invention as defined in the claims. Examples listed in parentheses may be used in the alternative or in any practical combination. As used in the specification and claims, the words 'comprising', 'including', and 'having' introduce an open ended statement of component structures and/or functions. In the specification and claims, the words 'a' and 'an' are used as indefinite articles meaning 'one or more'. While for the sake of clarity of description, several specific embodiments of the invention have been described, the scope of the invention is intended to be measured by the claims as set forth below. In the claims, the term "provided" is used to definitively identify an object that not a claimed element of the invention but an object that performs the function of a workpiece that cooperates with the claimed invention. For example, in the claim "an apparatus for aiming a provided barrel, the apparatus comprising: a housing, the barrel positioned in the housing", the barrel is not a claimed element of the apparatus, but an object that cooperates with the "housing" of the "apparatus" by being positioned in the "housing".

What is claimed is:

1. A disrupter cannon for launching water toward a provided explosive device to disable the explosive device, the disrupter cannon comprising:

a barrel having a bore, a breech-end portion, and a muzzle-end portion, the bore having a first diameter, the bore configured to hold the water;

a water-resistant cartridge, the cartridge includes a seal, the breech-end portion of the barrel configured to receive the cartridge;

a breech cap configured for coupling to the breech-end portion of the barrel;

a nozzle having an orifice, the nozzle configured for coupling to the muzzle-end portion of the barrel, the orifice having a second diameter; wherein:

prior to igniting the cartridge:

the cartridge is positioned in the breech-end portion of the barrel;

the water fills the bore and the nozzle;

the seal contacts an inner surface of the bore to retain the water in the bore and the nozzle;

the water contacts the cartridge;

the second diameter is less than the first diameter;

a rapidly expanding gas from the cartridge applies a force directly to the water to force the water from the bore and the nozzle through the orifice toward the explosive device; and a reduction from the first diameter to the second diameter results in an increase in a pressure of the water that exits the orifice whereby the increase in the pressure facilitates disabling of the explosive device.

2. The disrupter cannon of claim 1 wherein the second diameter is between one-eighth and one-fifteenth of the first diameter.

3. The disrupter cannon of claim 1 wherein the second diameter is one-tenth of the first diameter.

4. The disrupter cannon of claim 1 wherein the nozzle threadedly couples to the muzzle-end portion of the barrel.

5. The disrupter cannon of claim 1 wherein the nozzle removeably couples to the muzzle-end portion of the barrel.

6. The disrupter cannon of claim 1 wherein the increase in the pressure increases a likelihood that the water may penetrating a provided container of the explosive device to disable the explosive device.

7. The disrupter cannon of claim 1 further comprising a plug, wherein:

the plug is configured for inserting into the orifice; and prior to igniting the cartridge, the plug seals the orifice to retain the water in the bore and in the nozzle.

8. The disrupter cannon of claim 1 wherein the second diameter is between one-half and one-twentieth of the first diameter.

9. A disrupter cannon for launching water toward a provided explosive device to disable the explosive device, the disrupter cannon comprising:

a barrel having a bore, a breech-end portion, and a muzzle-end portion, the muzzle-end portion of the barrel having a first diameter, the bore configured to hold the water;

a reducer having a passage there through, the reducer configured to couple to the muzzle-end portion of the barrel, the passage having a second diameter, the reducer configured to hold the water; wherein:

prior to launching the water, the water fills the bore and the reducer;

the second diameter is less than the first diameter;

a rapidly expanding gas from a provided cartridge applies a force directly to the water to force the water from the bore and the reducer toward the explosive device;

while the reducer is coupled to the barrel, the water exits the barrel at a first force;

while the reducer is not coupled to the barrel, the water exists the barrel at a second force; and the second force is less than the first force.

10. The disrupter cannon of claim 9 wherein the reducer removeably couples to the muzzle-end portion of the barrel.

11. The disrupter cannon of claim 9 wherein the reducer threadedly couples to the muzzle-end portion of the barrel.

12. The disrupter cannon of claim 9 wherein the passage has a constant diameter.

13. The disrupter cannon of claim 9 wherein the passage has third diameter proximate to the muzzle-end portion of the barrel and the second diameter at a surface of the reducer away from the muzzle-end portion of the barrel.

14. A disrupter cannon for launching a liquid toward a provided explosive device to disable the explosive device, the disrupter cannon comprising:

a barrel having a bore, a breech-end portion, and a muzzle-end portion, the breech-end portion configured to receive a provided cartridge, the bore having a first diameter, the bore configured to hold the liquid;

a breech cap configured for coupling to the breech-end portion of the barrel;

a nozzle having an orifice, the nozzle configured for coupling to the muzzle-end portion of the barrel, the orifice having a second diameter; wherein:

prior to igniting the cartridge:

the cartridge is positioned in the breech-end portion of the barrel;

the liquid fills the bore and the nozzle; and the liquid contacts the cartridge;

the second diameter is less than the first diameter;

a rapidly expanding gas from the cartridge applies a force directly to the liquid to force the liquid from the bore and the nozzle through the orifice toward the explosive device; and a reduction from the first diameter to the second diameter results in an increase in a pressure of the liquid that exits the orifice whereby the increase in the pressure facilitates disabling of the explosive device.

15. The disrupter cannon of claim 14 further comprising a plug, wherein:

the plug is configured for inserting into the orifice; and prior to igniting the cartridge, the plug seals the orifice to retain the liquid in the bore and in the nozzle.

16. The disrupter cannon of claim 14 further the second diameter is between one-half and one-twentieth of the first diameter.

17. The disrupter cannon of claim 14 further comprising the cartridge, wherein the cartridge is liquid-resistant.

18. The disrupter cannon of claim 17 wherein:

the cartridge comprises a seal; and prior to igniting the cartridge, the seal contacts an inner surface of the bore to retain the liquid in the bore and the nozzle.

* * * * *